US006073929A

United States Patent [19]

Nahon

[11] Patent Number: 6,073,929

[45] Date of Patent: Jun. 13, 2000

[54] PUZZLE CONSTITUTED BY A PLURALITY OF PIECES TO BE ASSEMBLED

[76] Inventor: Jean-Charles Nahon, 4 boulevard Carnot, Montlucon, France, 03100

[21] Appl. No.: 09/105,084

[22] Filed: Jun. 26, 1998

[30] Foreign Application Priority Data

Jun. 27, 1997 [FR] France ..... 97 08375

[51] Int. Cl.[7] ..... A63F 9/10

[52] U.S. Cl. ..... 273/156; 428/33; 428/60

[58] Field of Search ..... 428/33, 60; 273/157 R, 273/156

[56] References Cited

U.S. PATENT DOCUMENTS 5,052,158 10/1991 D'Luzansky ..... 428/33

FOREIGN PATENT DOCUMENTS 2648358 12/1990 France .
2735375 12/1996 France .
2176411 12/1986 United Kingdom .
2231808 11/1990 United Kingdom .
2248402 4/1992 United Kingdom .
WO9633785 10/1996 WIPO .

*Primary Examiner*—Alexander Thomas
*Attorney, Agent, or Firm*—Dowell & Dowell, P.C.

[57] ABSTRACT

A puzzle consisting of several pieces to be assembled to form a structure of predetermined shape or aspect, each piece including at least one tongue or a cut-out into which is to be fitted a tongue of an adjacent piece. Each tongue or cut-out is chamfered with respect to the surface of the piece along a periphery of the tongue or cut-out, and wherein each tongue or cut-out is provided with a counter-chamfer extending along at least a portion of the chamfer of the tongue or cut-out.

10 Claims, 9 Drawing Sheets

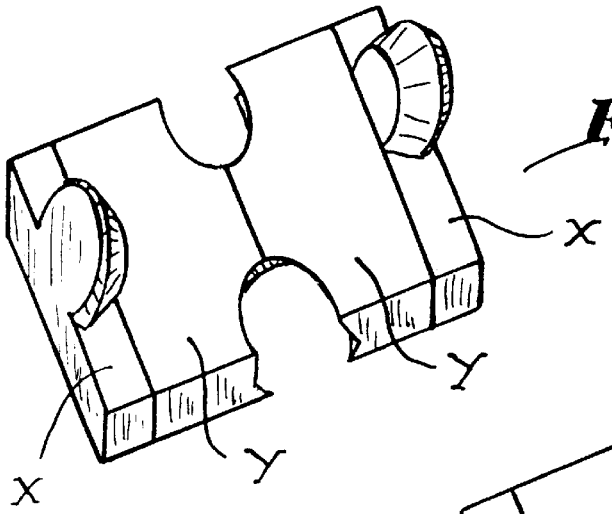
Fig. 13d
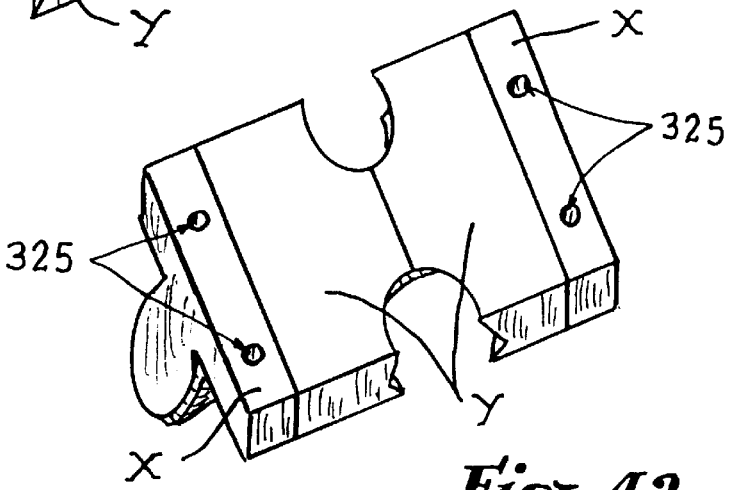
Fig. 13e
Fig. 13f
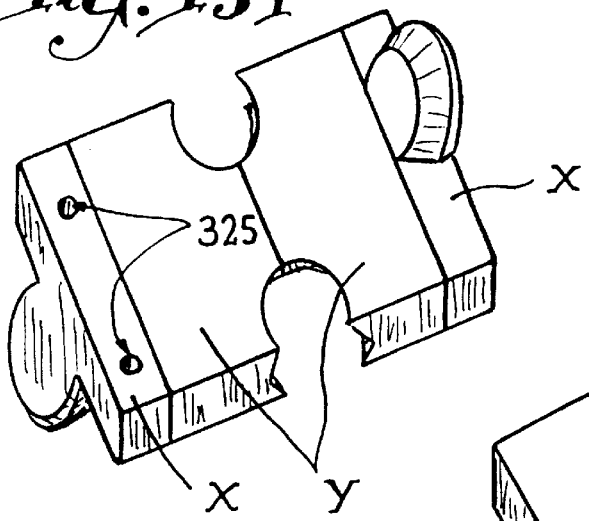
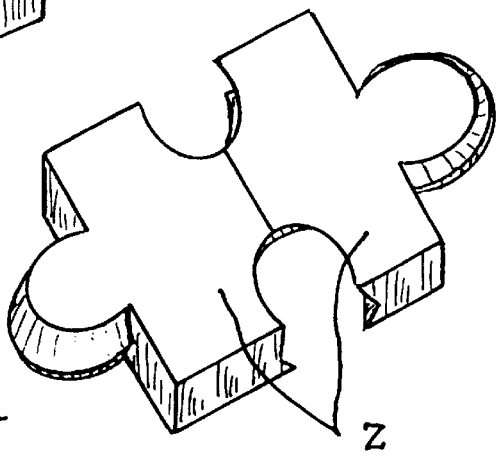
Fig. 13g

PUZZLE CONSTITUTED BY A PLURALITY OF PIECES TO BE ASSEMBLED

BACKGROUND OF THE INVENTION

1. Field of the Invention

The invention relates to a puzzle constituted by several pieces that are joined to each other in order to form a structure of predetermined shape.

2. Brief Discussion of the Related Art

From patent No. FR-2 648 358 is known a puzzle constituted by non-plane pieces of constant thickness, each of which pieces is provided with two tongues and two cut-outs that are symmetrically located with respect to the center of the piece. This puzzle requires the use of immobilization clips, of letter clip type, in order to keep the pieces forming the upper edge of the object aligned during the assembly or after having finished it. The use of such clips that must be placed on each row of pieces and then withdrawn during the assembly of the object could prove to be tedious for the user.

Furthermore, each piece must of the known system be of a specific geometry, namely, it must have two cut-outs and two tongues that face each other in twos, while each row constituting the object being assembled must necessarily consist of an even number of pieces. These constraints limit the applications of the puzzle thus created.

SUMMARY OF THE INVENTION

The present invention has the specific aim to remedy these disadvantages by submitting a new geometry of the constituent pieces of the puzzle, allowing a firm interlocking with each other, including during the assembly, so that the use of clips can be avoided. The present invention also aims to propound an interlocking system for the pieces of the puzzle, allowing to give these pieces a diverse geometry without any constraints regarding the number and the direction of the tongues and the cut-outs.

With this in mind, the present invention relates to a puzzle constituted by several pieces to be assembled in order to form a structure of a predetermined shape or aspect, each of which pieces is provided with at last one tongue or one cut-out for the interlocking of a tongue of an adjacent piece; each tongue or cut-out has a chamfered edge on its periphery with respect to the surface of said piece, characterized by the fact that each tongue or cut-out is provided with a counter-chamfer over at least a portion of the periphery of said tongue or cut-out.

Thanks to the counter-chamfer, the pieces are effectually kept interlocked when the tongues are fitted into the respective cut-outs.

In a first embodiment of the invention, the counter-chamfer extends substantially over the entire periphery of the tongue or of the cut-out. This aspect of the present invention allows to distribute the strains on the chamfer and on the counter-chamfer over the entire periphery of the tongue and the cut-out.

In a second embodiment of the invention, the counter-chamfer is constituted by several sequentially distributed sections over the periphery of the tongue and of the cut-out. This geometry, in which the counter-chamfer is formed by fixing-clip stubs provided in each cut-out while the respective notches are provided on the tongues, facilitates the fitting of the tongues into the respective cut-outs.

In accordance with another advantageous aspect of the invention, applicable to whichever might be the contemplated embodiment, extraction notches are provided at the base of the tongues. These notches prevent the formation of an undercut piece in the interloking area of the tongues with the principal part of the piece. This absence of undercuts precludes the use of complex molds provided with slides.

In accordance with another advantageous aspect of the present invention, the outside edges of each piece are slanted with respect to the perpendicular to the surface of the piece at each point of their edges, which edges converge on the side of the center of the curvature of the surface of the piece. This geometry of the outside edges of the piece allows to obtain a good interlocking of the external surface of these pieces, that is to say, the external surface of the object obtained with the puzzle of the invention, without however these edges coming into contact to such a point that, due to the fact of the tolerances of manufacture, their fitting would be impeded.

In accordance with another advantageous aspect of the present invention, the tongues can have a different thickness than the body of the pieces. Due to this aspect of the invention, the creator of the puzzle is given more freedom in defining the pieces.

In accordance with another advantageous aspect of the present invention, at last one tongue extends in a direction not parallel to the surface of the corresponding piece in the interlocking area of the tongue to the piece. Thus, this aspect of the invention allows to provide tongues that run in almost any direction with respect to the body of the piece which, once again, gives more freedom of choice to the creator of the puzzle.

It can also be envisaged that the back side of the pieces present lightening hollows, which results in a saving of material, thus of weight, in the industrial manufacture of these pieces.

In accordance with another advantageous aspect of the present invention, at last one piece is formed by several elements joined by the interaction of shapes. In other words, it can be envisaged that each piece provided with tongues or cut-outs is constituted by several auxiliary pieces, which would render the puzzle more complex, and thus more interesting, and prevent that a miniaturization of the pieces with too many details would not lead to their weakening.

In accordance with another advantageous aspect of the present invention, the puzzle comprises a self-supporting frame formed by elements joined by the interaction of shapes; the majority of these elements is provided with at last one cut-out or a tongue interlocking with the other pieces of the puzzle. This aspect of the invention is used when the puzzle consists in obtaining a plane image, in the manner of a standard puzzle; thus, the frame is a structure that shows the image once it is obtained. In the case of a tridimensional piece, such as a vase, the frame can be a border free of the object to be mounted.

BRIEF DESCRIPTION OF DRAWINGS

The invention will be better understood and some other of its advantages will be shown more clearly through the below description of five embodiments of the pieces belonging to a puzzle in accordance with the invention, given only by way of example and making reference to the accompanying illustrations wherein.

DESCRIPTION OF THE PREFERRED EMBODIMENTS

Figure 1:
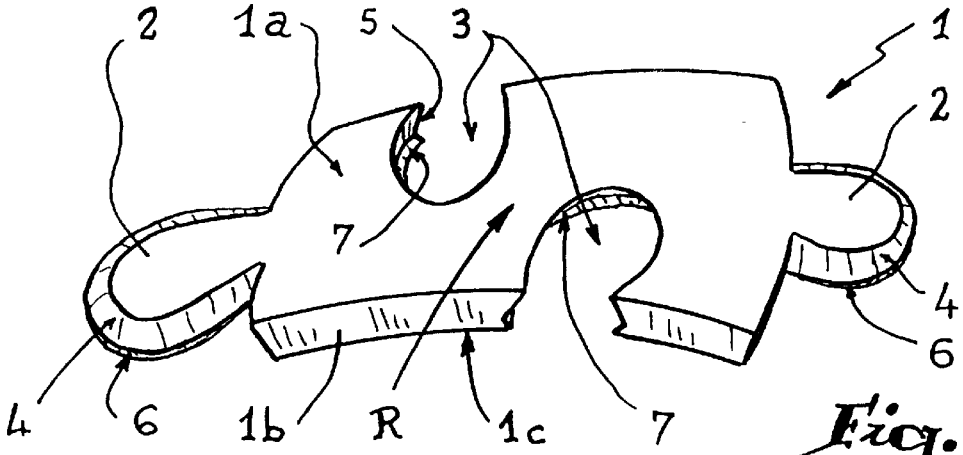
FIG. 1 shows a view in perspective of a piece belonging to a puzzle in accordance with the invention.

The piece 1 illustrated in FIG. 1 is intended to be assembled with analogous pieces in order to form a tridimensional object. To accomplish this, the piece 1 is provided with various tongues 2 and cut-outs 3 distributed along its periphery depending on the choice of the designer of the puzzle to which the piece belongs. The tongues 2 and the cut-outs 3 are chamfered, that is to say, their surfaces 4 or 5, respectively, are slanted with respect to the main external surface la of the piece 1 in the proximity of each tongue or cut-out.

Figure 2:
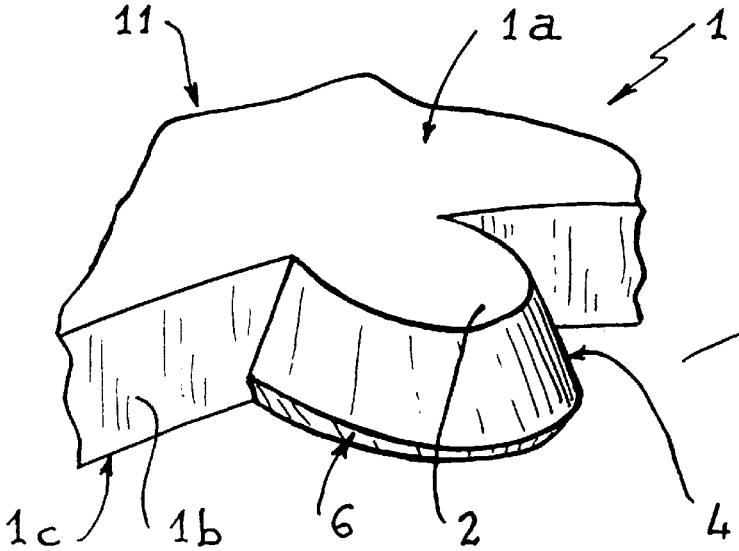
FIG. 2 shows a view in perspective of a tongue of the piece of FIG. 1 at enlarged scale.
Figure 3:
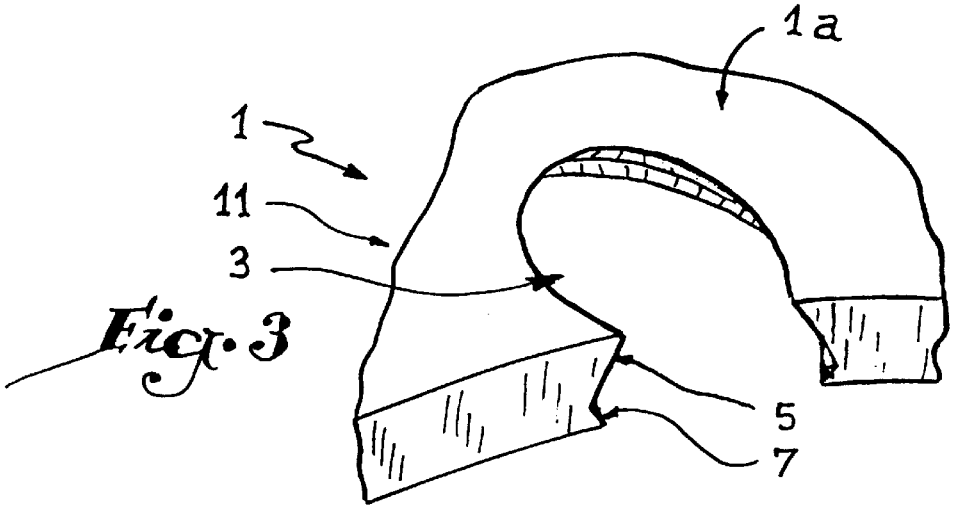
FIG. 3 shows a view in perspective of a cut-out of the piece of FIG. 1 at enlarged scale.

In accordance with the present invention, and as it can be seen more clearly in FIG. 2, each tongue 2 is provided with a counter-chamfer 6, that is to say, with a slanted surface not parallel to the chamfer 4. In the same manner, and as it can be sen more clearly in FIG. 3, each cut-out 3 is flanged both by the chamfer 5 and by a counter-chamfer 7 not parallel to the chamfer 5. Thus, when the tongue 2, illustrated in FIG. 2, enters into a cut-out of an adjacent piece of such type as illustrated in FIG. 3, this tongue is effectually kept in position in directions parallel to the surface la and in directions perpendicular to the surface la thanks to the chamfers and counter-chamfers 4 to 7. In other words, the counter-chamfers 6 and 7 render it possible to prevent that the chamfers 4 and 6 do not slide against each other, which would cause the tongue 2 to separate from the cut-out of the type of cut-out 3 with which it is interlocked.

In the course of the present description, the cut-out of the type of the cut-out 3 into which locks the tongue 2 and that belongs to another piece, is compared with the cut-out 3 of the piece 1.

In order to fit the tongue 2 into the corresponding cut-out 3, a slight deformation of the counter-chamfer 7 and even of the assembly of the tongue 2 and the cut-out 3 is necessary. This deformation is nullified under the effect of the elastic properties of the materials used, such as plastics, so that when fitting the tongue into the corresponding cut-out, the relative immobilization of the tongue and of the cut-out is obtained by an interaction of the shapes that can be relatively precise.

It can be noted that the counter-chamfers 6 and 7 extend substantially over the entire periphery of the tongue 2 or of the cut-out 3, so that they efficaciously effectuate their function of locking and of distribution of strains over the entire periphery of the tongue.

Figure 4:
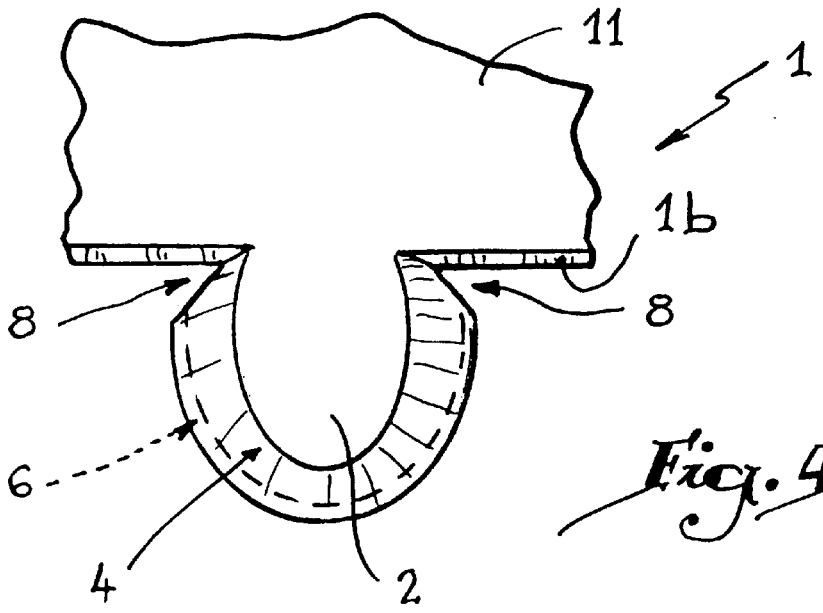
FIG. 4 shows a plane view of the tongue illustrated in FIG. 2.

In accordance with an advantageous aspect of the present invention, particularly seen in FIG. 4, and to prevent the use of a mold with complex slides, at the base of the tongues, that is to say, in their interlocking areas with the main portion 11 of the piece 1, are provided extraction notches 8. These notches 8 prevent the formation of undercut areas that could not be obtained without a mold with slides. Thus, this aspect of the present invention allows the use of a simple material and therefore a good control over the cost of the puzzle pieces in accordance with the present invention.

Figure 5:
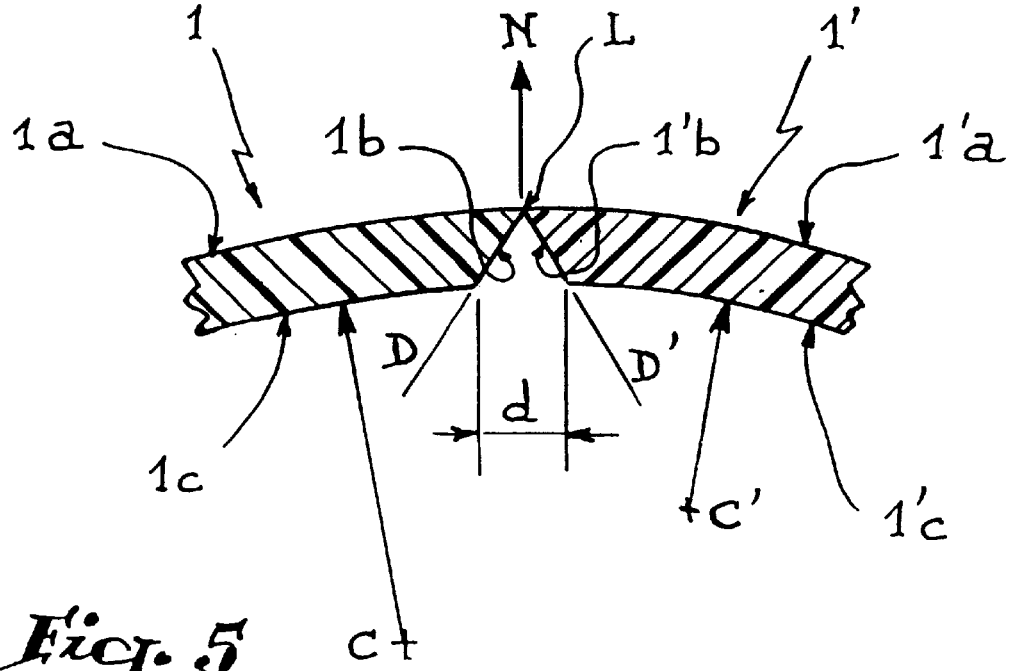
FIG. 5 shows a partial diagrammatic illustration of two juxtaposed pieces of the type illustrated in FIG. 1.

In accordance with another advantageous aspect of the present invention, particularly seen in FIG. 5, when two pieces 1 and 1' are juxtaposed, their external surfaces 1*a* and 1'*a*, respectively, are contiguous along their connecting lines L. However, taking into account the tridimensional or skewed nature of the pieces obtained in accordance with the invention, it matters that the contiguous nature of the surfaces 1*a* and 1'*a* does not create an inconvenience on the back side 1*c* or 1'*c* of the pieces 1 and 1'. In order to acccomplish this, the external edges of the pieces 1 and 1' are slanted depending on the directions D and D' with respect to the perpendicular N to the surfaces 1*a* and 1'*a* of the pieces 1 and 1', being the directions D and D' such that the edges 1*b* and 1'*b* are oriented toward the centers of the curvature C and C', respectively, of the pieces 1 and 1'. On their back sides 1*c* and 1'*c*, the edges 1*b* and 1'*b* are separated by a not nil distance d. Thus, one prevents the risks of jamming the pieces 1 and 1' during their assembly.

Figure 6:
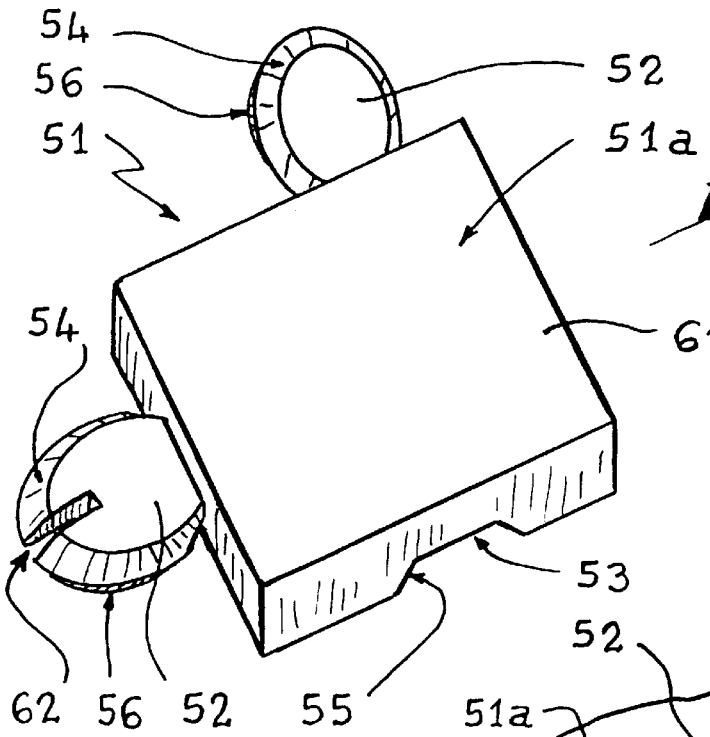
FIG. 6 shows a view in perspective of a piece in accordance with a second embodiment of the invention.
Figure 7:
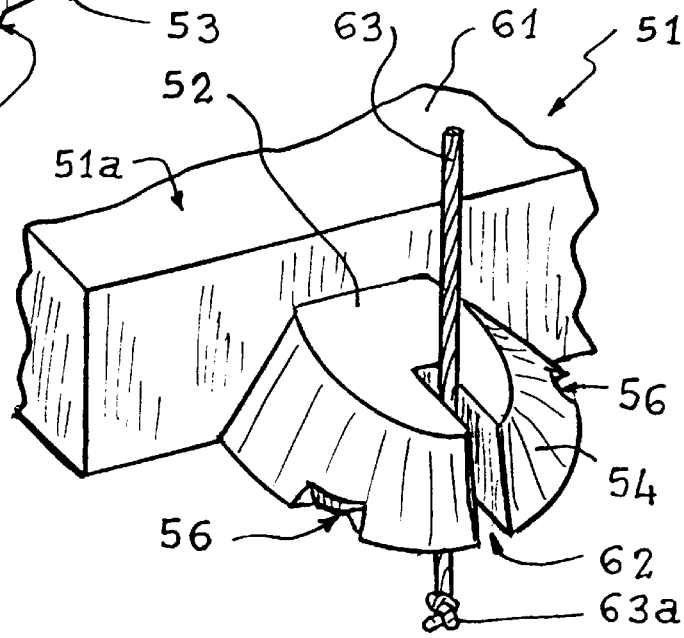
FIG. 7 shows a view analogous to that of FIG. 2 of the piece illustrated in FIG. 6.
Figure 8:
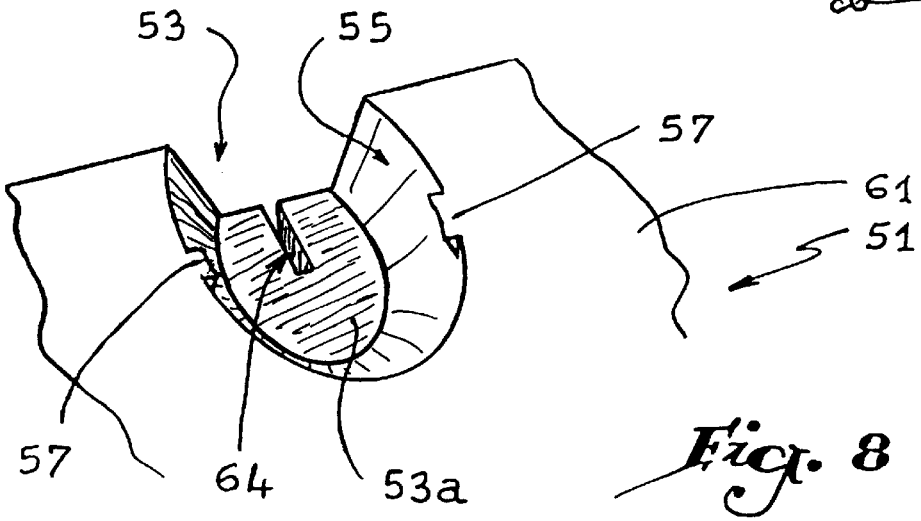
FIG. 8 shows a view from below of a cut-out of the piece illustrated in FIG. 6.

In a second embodiment of the present invention illustrated in FIGS. 6 to 8, the elements analogous to those of the embodiment illustrated in FIGS. 1 to 5 carry the same reference numbers but increased by 50. The piece 51 illustrated in FIG. 6 differs from the preceding one in that the tongues 52 and the cut-outs 53 have a different thickness than that of the body 61, that is to say, of the main portion of the piece 51. As it can be seen more clearly from FIGS. 7 and 8, each tongue 52 and each cut-out 53 is provided with a chamfered surface 54 and 55, respectively, with respect to the external surface 51*a* of the piece 51. Counter-chamfers 56 and 57, respectively, are sequentially distributed along the periphery of the tongue 52 and of the cut-out 53. These counter-chamfers 56 and 57, that are shaped like stubs and fixing-clips, have essentially the same function as the chamfers 6 and 7 of the first embodiment.

However, due to the fact that they only occupy a portion of the periphery of the elements 52 and 53, these elements must be deformed only in some areas when the tongue 52 is fitted into the cut-out 53. Thus, it is made easier to fit the tongue into the cut-out.

Due to the fact that the tongue 52 is not as thick, the chamfers 54 and 55 are not as thick as in the preceding embodiment. One can also envisage that the chamfers 54 and 55 are spherical, the tongue looking like a "ball" when seen from the above, while a counter-chamfer is still provided on its bottom portion.

It must be understood that the studs can also be formed on tbe tongue 52 while the corresponding notches would be formed on the edge of the cut-out 53.

The tongue 52 is also provided with a notch 62 into which can be inserted a thread or a cord 63 whose end 63*a* is knotted so that it is wider than the notch 62; when the tongue 52 is in place in the cut-out of the type of cut-out 53, the free end of the notch 62 is formed by the chamfer 55 so that the cord 63 is firmly held in the notch 62. A notch 64 is provided on the center 53*a* of the cut-out 53 in order to allow the passing of the cord 63 when the tongue 52 is fitted into the corresponding cut-out 53. This can be used to attach a cord to the object obtained thanks to the puzzle of the invention, which would allow a subsequent use of the thus obtained object. For example, the object obtained thanks to the puzzle can be a key ring provided with a ring for the holding of the keys, which key ring is attached to the not illustrated end of the cord 63.

Figure 9:
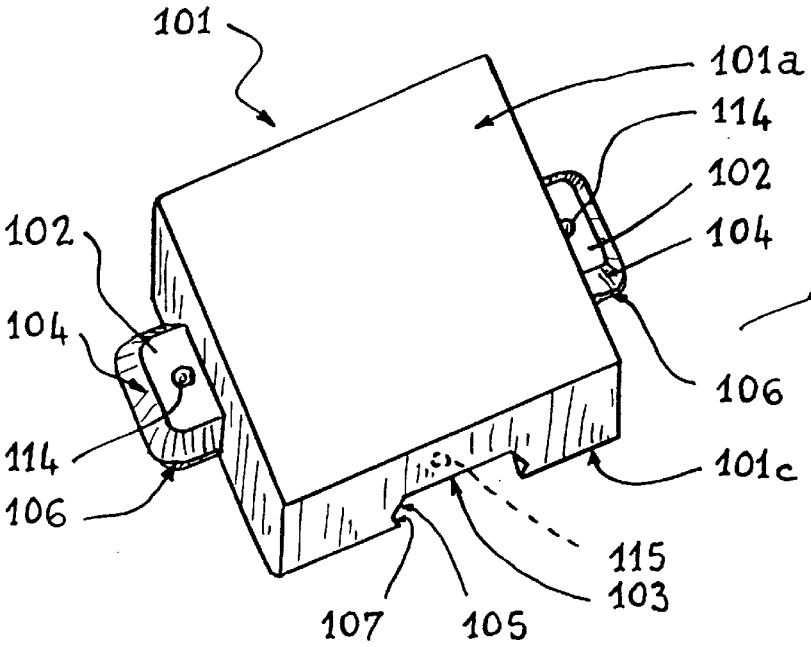
FIG. 9 shows a view in perspective of a piece in accordance with a third embodiment of the present invention.

In the third embodiment of the present invention illustrated in FIG. 9, the elements analogous to those of the embodiment illustrated in FIGS. 1 to 5 carry the same reference numbers but increased by 100. In this embodiment, the piece 101 is provided with tongues 102 and cutouts 103 whose sides have chamfers 104 and 105, respectively, and counter-chamfers 106 and 107. The tongues are also provided with elements 114 formed on the upper surface of each tongue 102, that is to say, on the surface of the tongue that runs parallel to the external surface 101*a* of the piece 101. Each cut-out 103 is also provided with a housing 115 to receive the stud 114 of the respective tongue. The housing 115 is arranged on a surface of a cut-out 103 turned towards the back of the piece 101, that is to say, in direction toward the back surface 101*c*.

As in the embodiment of the FIGS. 6 to 8, the tongues 102 are less thick than the body 111 of the piece 101, so that the cut-outs 103 are not shown on the external surface 101*a* of the piece 101, which improves the aesthetic aspect of the object obtained thanks to the puzzle.

Figure 11:
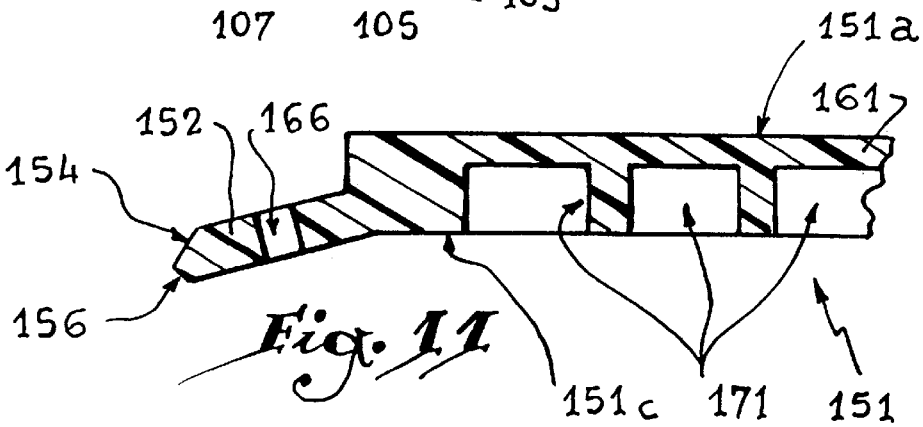
FIG. 11 shows a cross-section at enlargeded scale along the line XI—XI of FIG. 10.
Figure 10:
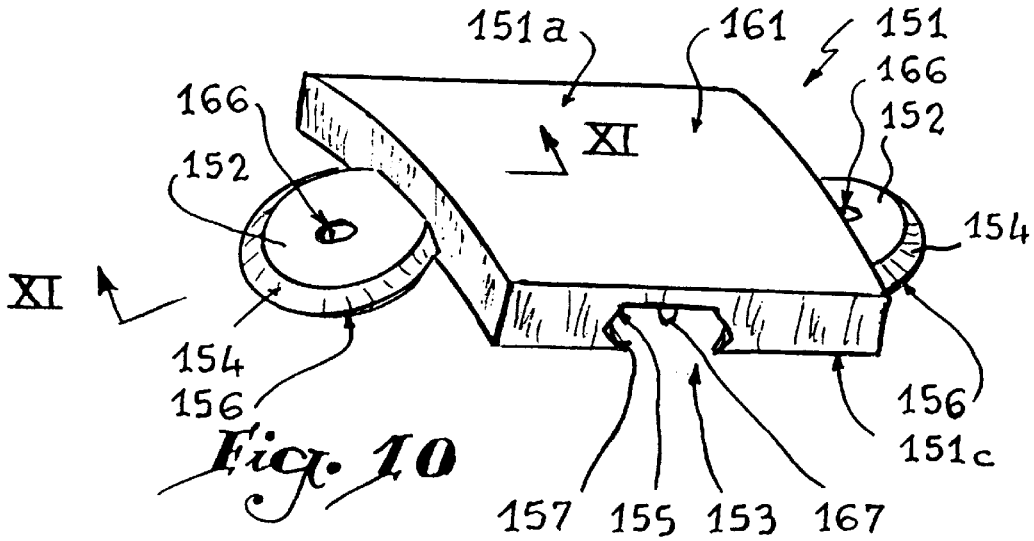
FIG. 10 shows a view in perspective of a piece in accordance with a fourth embodiment of the present invention.

In the fourth embodiment of the present invention illustrated in FIGS. 10 and 11, the elements analogous to those of the embodiment illustrated in FIGS. 1 to 5 carry the same reference numbers but increased by 150. The piece 151 of this embodiment comprises tongues 152 intended to fit into the cut-outs analogous to the cut-outs 153 of the piece 151.

As before, the tongues 152 and the cut-outs 153 are flanged by the chamfers 154 and 155 and by the counter-chamfers 156 and 157. The tongues 152 are less thick than the body 161 of the piece 151.

As it can be seen more clearly in FIG. 11, the tongue 152 is not parallel to the external surface 151*a* of the piece 151 in the interlocking area of the tongue 152 to the body 161 of the piece 151.

The tongue 152 is provided with a central bore hole 166, while each cut-out 153 is provided with a stud 167 to fit into the bore hole of the tongue. The interaction of the bore hole 166 and of the stud 167, as well as that of the stud 114 and a housing 115 of the foregoing embodiment, facilitate an even more increased immobilization of the tongues with respect to the cut-outs into which they are fitted.

In accordance with another advantageous aspect of the present invention, the back side 151*c* of the piece 151 is provided with hollows 171 which makes the piece 151 lighter without altering its external aspect since the surface 151*a* is not modified by the presence of the hollows 171. These hollows 171 may extend or not as far as the lateral edges of the body 161 of the piece 151.

In order to render the puzzle of the invention even more complex, that is to say, more interesting, it can be contemplated to miniaturize the pieces, which would also allow, by using a rather large number of pieces, the obtaining of objects whose spatial requirement, once assembled, is reduced.

However, if one reduces all the sizes of the piece 1 illustrated in FIG. 1, the area R situated between two adjacent cut-outs constitutes an area of potential separation, which is not acceptable to the user.

In order to remedy this disadvantage, that occurs in puzzles regardless of the presence of a chamfer and a counter-chamfer on the tongues and the cut-outs, certain pieces of the puzzle in accordance with the invention are formed with several elements assembled by interaction of shapes, that is to say, by a fitting of tenon and mortise.

Figure 12A:
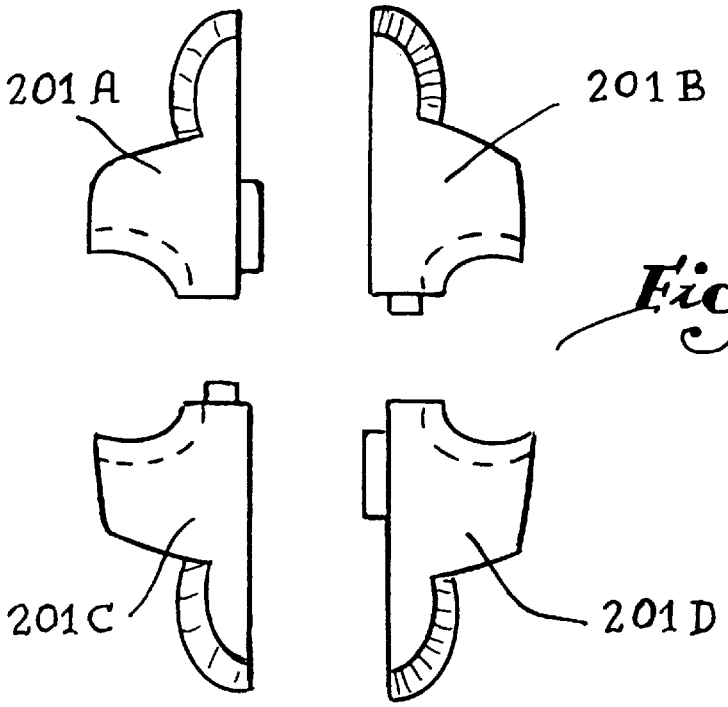
FIG. 12 shows a diagrammatic representation of the division of a piece of a puzzle in accordance with the present invention according to three sections illustrated in FIGS. 12*a*, 12*b* and 12*c*, respectively.
Figure 12B:
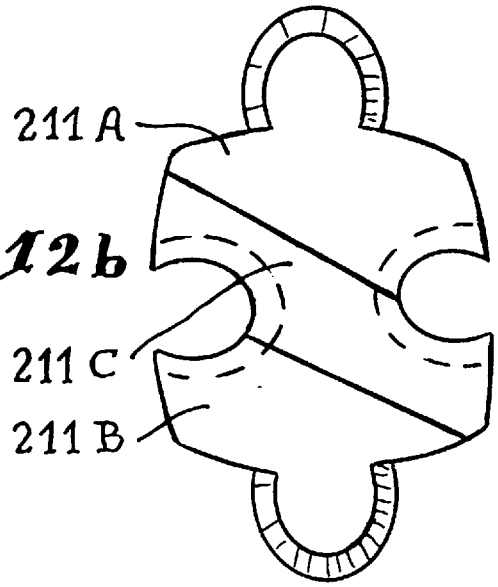
Figure 12C:
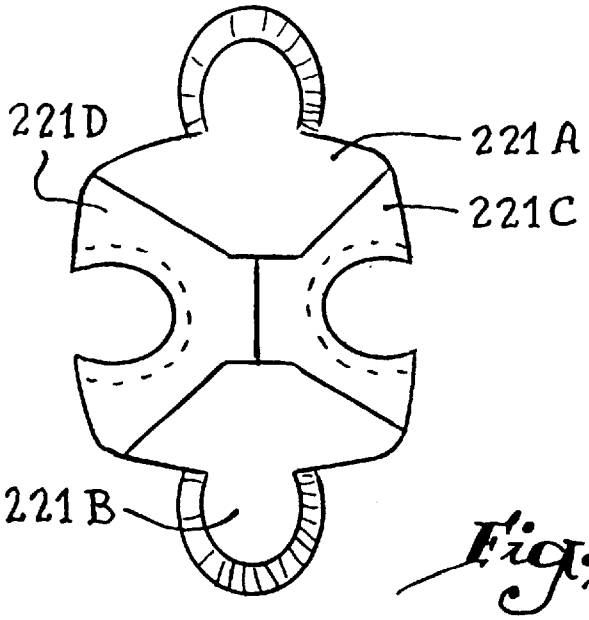

In FIGS. 12*a* to 12*c* are illustrated various methods to form a piece of a puzzle in accordance with the invention with the elements 201A to 201D or 211A to 211C or 221A to 221D. It can be noted that at least some of the elements 201, 211 and 221 can be identical to each other, such as the elements 201A and 201D, 201B and 201C, 211A and 211C, 221A and 221B, or 221C and 221D. This allows to add a variant to the puzzle in accordance with the invention, according to which the user must build the pieces he wishes to use starting with elements intended to be assembled by the interaction of shapes.

Another variant of this aspect of the invention can also be implemented according to the illustration of FIG. 13. In this figure, it is assumed that a piece is constituted by using three elements X, Y and Z intended to be assembled to each other by studs 324 provided to lodge in the corresponding housings 325.

Figure 13A:
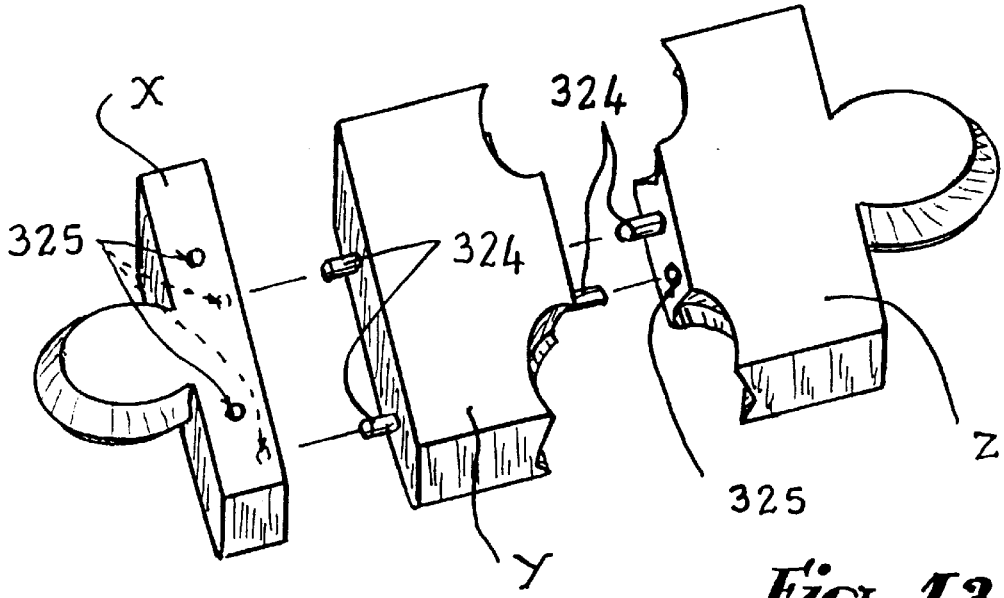
FIG. 13 shows another example of the division of a piece, illustrated in an exploded view in FIG. 13*a* and in various assembled positions in FIGS. 13*b* to 13*g;*
Figure 13B:
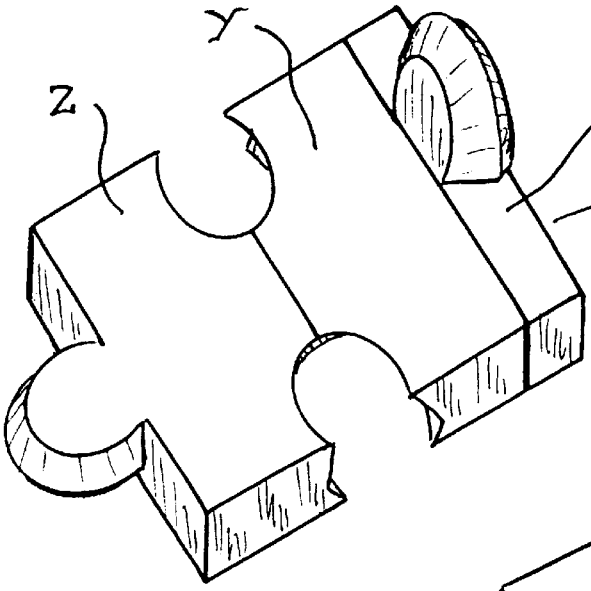
Figure 13C:
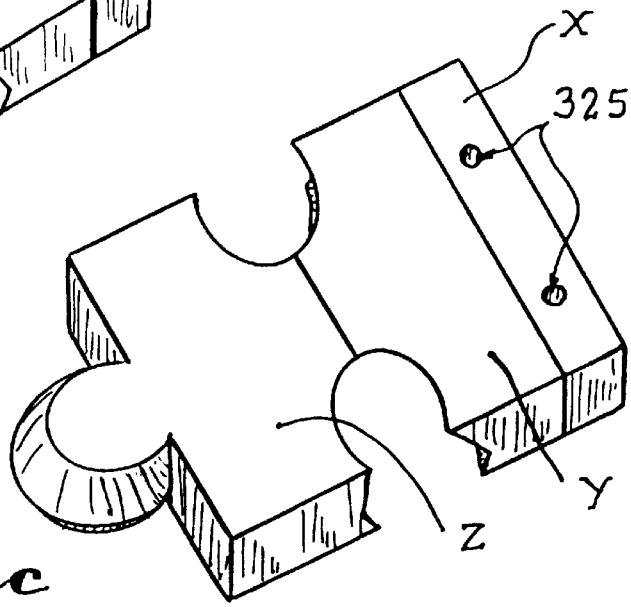

The elements X, Y and Z can be assembled in different manners to constitute a plane piece, of the same type as illustrated in FIG. 12, shown in FIG. 13*a*, but also pieces of varied geometry in which the tongues can extend parallel to the main direction of the piece (FIG. 13*a*) but also perpendicular to this direction (FIGS. 13*b* to 13*f*.

Figure 14:
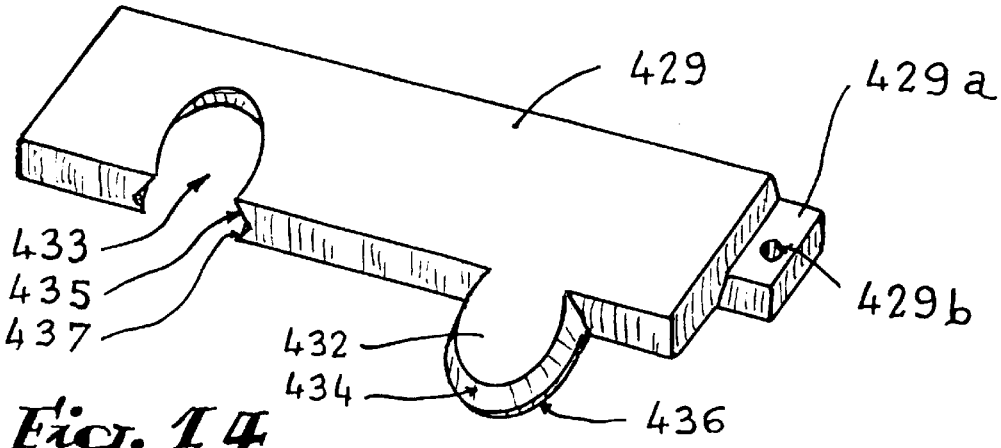
FIG. 14 shows a view in perspective of an element belonging to a frame forming part of the puzzle in accordance with the present invention.
Figure 15:
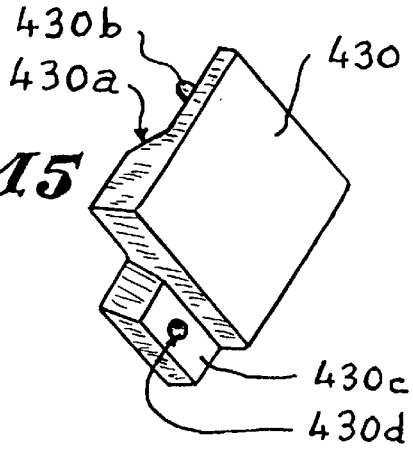
FIG. 15 shows a view in perspective of a piece intended to interlock with piece 14 in order to form a frame.
Figure 16:
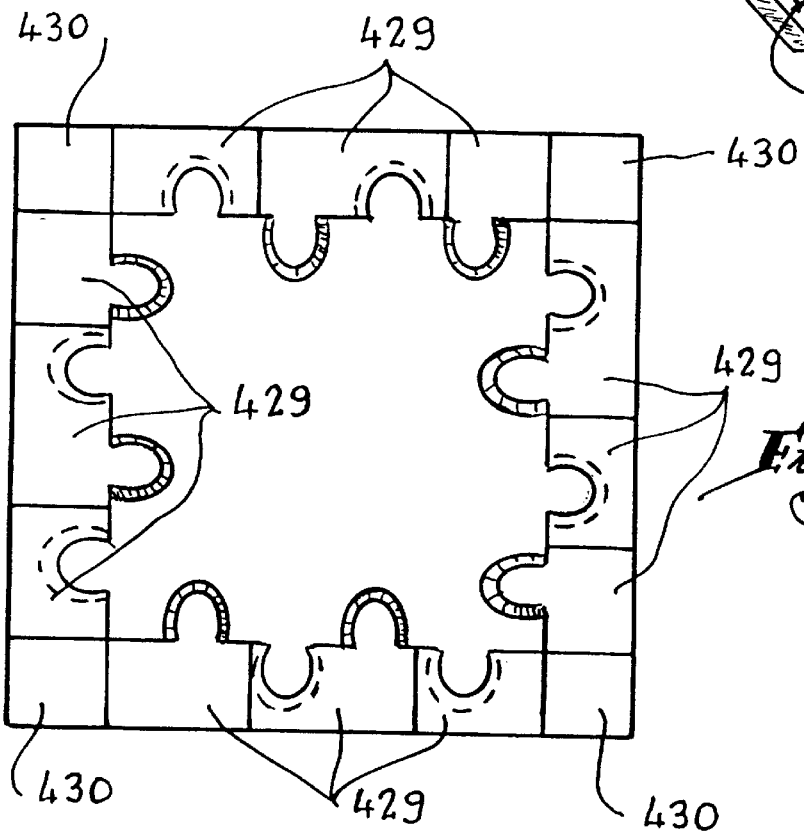
FIG. 16 shows a diagrammatic representation of a frame formed with pieces of such type as those illustrated in FIGS. 14 and 15.

In the case of a plane image and in accordance with another advantageous aspect of the invention, it is also possible to provide a frame 428 formed by individual elements 429 and 430, illustrated in FIGS. 14 and 15, respectively, and designed to be assembled by the interaction of shapes. For example, an extension 429*a* on the element 429 is provided with a housing 429*b* to lodge a stud 430*b* placed on the bottom surface of a recess 430*a* for the lodging of the extension 429*a*. The element 430 does also have an extension 430*c* provided with a housing 430*d* analogous to the extension 429*a* and the housing 429*b* of the element 429. As it can be seen more clearly in FIG. 16, the self-supporting frame 428, that is to say, rigid and intended to support the other pieces, can be formed starting with several elements 429, that can have a diversified geometry, and four elements 430 intended to constitute the corners. Each element 429 is provided with at last one cut-out 433 or at least one tongue 432, respectively, provided with chamfers 435 and 434 and counter-chamfers 437 and 436.

Figure 17:
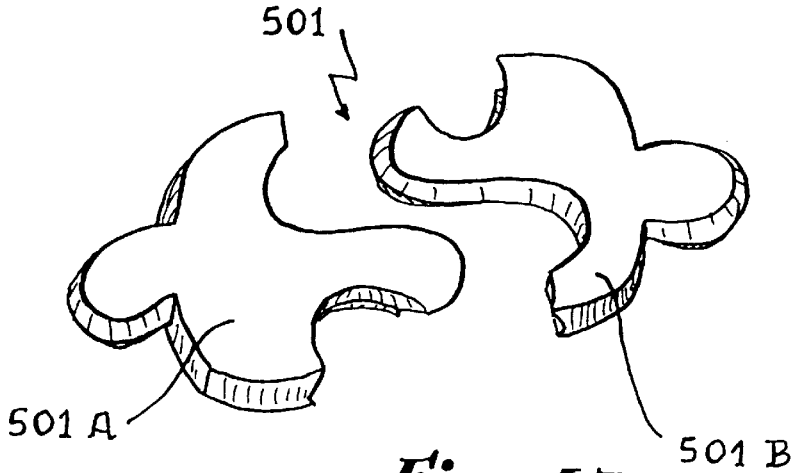
FIG. 17 shows a view in perspective of a key piece in accordance with a fifth embodiment of the present invention.

Lastly, in order to facilitate the fitting of the last piece of the puzzle and taking into account the deformations that must be obtained for the fitting of the tongues into the cut-outs because of the presence of the counter-chamfers, the last piece of the puzzle or the key piece 501, illustrated in FIG. 17, can be divided into two parts 501A and 501B, each provided with one or several tongues, one or several cut-outs, or portions of tongues or of cut-outs. The parts 501A and 501B are intended to be put into place independently with respect to the other pieces of the puzzle and to be assembled by any adopted means, such as by fixing-clip, or by assembly of tenon and mortise type.

Figure 18:
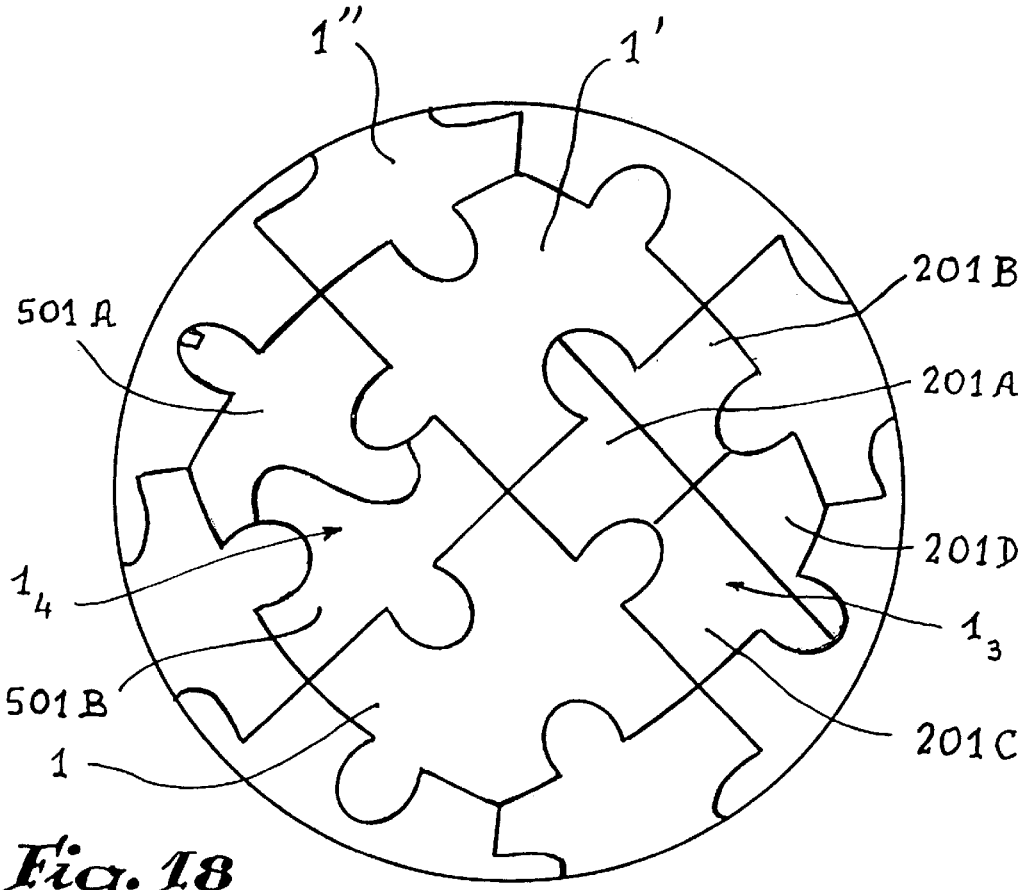
FIG. 18 shows an example of a spherical object obtained with the help of the puzzle in acordance with the present invention.

In FIG. 18, a sphere that can represent a globe or a balloon is obtained thanks to a puzzle in accordance with the invention. This sphere is constituted by a certain number of pieces 1, 1', 1" etc . . . of which one, $\mathbf{1}_3$, is made in four parts in the manner described in reference to FIG. 12, and of which another one, $\mathbf{1}^4$, constitutes a locking piece of the type of piece 501, represented in FIG. 17. In this design are used the references 210*a* to 201C, 501A and 501B for the elements corresponding to the FIGS. 12 and 17. This globe can be constituted by 24 pieces or by 96 pieces depending on the sought intricacy.

It goes without saying that the creativity offered by this system of puzzle is very great and that the objects obtained can be of whatsoever type, such as, for example, vases, statues, cars, rockets, etc . . .

What is claimed is:

1. A puzzle comprising: a plurality of pieces to be assembled to form a structure of predetermined shape or aspect, each piece including at least one tongue or a cut-out into which is to be fitted a tongue of an adjacent piece, each tongue or cut-out including a chamfer with respect to a surface of said piece along a periphery of said tongue or cut-out and having a counter-chamfer extending over at least a portion of said chamfer of said tongue or cut-out.

2. A puzzle in accordance with claim 1 wherein said counter-chamfer extends essentially along the entire periphery of said tongue or said cut-out.

3. A puzzle in accordance with claim 1 wherein said counter-chamfer is constituted by several parts sequentially distributed over the periphery of said tongue or said cut-out.

4. A puzzle in accordance with claim 1 including extraction notches formed at a base of said tongues.

5. A puzzle in accordance with claim 1 wherein external edges of each piece are slanted with respect to the perpendicular (N) to said surface of each piece at each point of said external edges, and said external edges are convergent at a side of a center of curvature (C', C') of said surface of each piece.

6. A puzzle in accordance with claim 1 wherein said tongues have a different thickness than that of a body of said pieces.

7. A puzzle in accordance with claim 1 wherein at least one tongue extends in a direction not parallel to said surface of said corresponding piece in an interlocking area of said at least one tongue to said corresponding piece.

8. A puzzle in accordance with claim 1 wherein said pieces have lightening hollows on a back side.

9. A puzzle in accordance with claim 1 wherein at least one piece is formed by several interlocking elements.

10. A puzzle in accordance with claim 1 including a self-supporting frame formed by interlocking elements, the majority of said elements being provided with at least one cut-out or a tongue for locking of other pieces of the puzzle.

* * * * *